US007058983B1

(12) United States Patent
Namiki

(10) Patent No.: US 7,058,983 B1
(45) Date of Patent: Jun. 13, 2006

(54) NECKTIE

(76) Inventor: Tosiki Namiki, 120-1 Nozawa, Saku-shi, Nagano (JP) 385-0053

( * ) Notice: Subject to any disclaimer, the term of this patent is extended or adjusted under 35 U.S.C. 154(b) by 0 days.

(21) Appl. No.: 11/216,050

(22) Filed: Sep. 1, 2005

(30) Foreign Application Priority Data

Mar. 14, 2005 (JP) ..... 2005-001298

(51) Int. Cl.
*A41D 25/00* (2006.01)

(52) U.S. Cl. ..... 2/144

(58) Field of Classification Search ..... 2/144–150, 2/152.1, 153, 155–157; 24/49.1, 50, 66.11; 63/3, 3.1, 3.2, 4, 15
See application file for complete search history.

(56) References Cited

U.S. PATENT DOCUMENTS 5,253,366 A * 10/1993 Marlo et al. ..... 2/145
5,526,550 A * 6/1996 Huang ..... 24/66.2
6,564,582 B1 * 5/2003 Brachfeld ..... 63/3.2

* cited by examiner

*Primary Examiner*—Tejash Patel
(74) *Attorney, Agent, or Firm*—Bacon & Thomas, PLLC

(57) ABSTRACT

A necktie contains a winding portion ring-shaped and wound around the neck when the necktie is worn, an ornamental portion provided at one end portion of the winding portion and hung down from the front of the neck to the chest, and a clasp provided at the other end of the winding portion and attachable to and removable from any position of the winding portion. The necktie can be easily worn in such a way that, after the winding portion has been wound around the neck, the winding portion is attached by the clasp so as to be ring-shaped. Then, a good design can be secured by making the ornamental portion a chain, downward sword-shaped, rectangular, and others so as to be freely bendable. Accordingly, the necktie is appropriate for the use by not only men, but also women.

4 Claims, 5 Drawing Sheets

NECKTIE

BACKGROUND OF THE INVENTION

1. Field of the Invention

The present invention relates to a necktie and more particularly to a necktie using a chain, and other chains.

2. Description of the Related Art

In general, neckties having a large width portion at an end thereof, being downward sword-shaped, and made of a cloth are known. When the neckties are worn around the neck, after the neckties have been wound around the neck passing them through the collar of a shirt, etc., a knot portion is formed by knotting the neckties so they can be worn (for example, see Japanese Unexamined Patent Application Publication No. 2003-20509).

Neckties are worn by many people, and so after the neckties have been passed through the collar portion of a shirt, etc., and wound around the neck, the neckties are knotted and tightened. Accordingly, it takes time and there have been cases in which length adjustment is not properly performed.

Furthermore, since the persons who wear neckties have been men, there have not been neckties which suit women's taste and, as a result, the neckties have not been used by women.

SUMMARY OF THE INVENTION

In order to solve the above problems, it is an object of the present invention to provide a necktie which is easily worn around the neck and is appropriate in design for not only men, but also women.

A necktie of the present invention comprises a winding portion formed in a ring shape and wound around the neck by a clasp; and an ornamental portion connected to the winding portion and hanging down to the chest from the front of the neck.

Furthermore, a necktie of the present invention comprises a winding portion and an ornamental portion integrally formed by a chain; and a clasp attached to the other end, opposite to the ornamental portion, of the winding portion. In the necktie, when the clasp is attached to the winding portion, the winding portion to be wound around the neck and the ornamental portion hanging down to the chest from the front of the neck are formed.

Moreover, a necktie of the present invention comprises a winding portion made of a chain formed in a ring shape by a clasp provided at one end of the chain so as to be wound around the neck; and an ornamental portion attached to the other end, opposite to the clasp, of the winding portion. In the necktie, the ornamental portion is made of a linear body being downward sword-shaped and the whole body can be bent in any direction.

Moreover, a necktie of the present invention comprises a winding portion made of a chain formed in a ring shape by a clasp provided at one end of the chain so as to be wound around the neck; and an ornamental portion attached to the other end, opposite to the clasp, of the winding portion. In the necktie, the ornamental portion is made of a linear body being rectangular in an upward and downward direction and the whole body can be bent in any direction.

As described above, since a necktie of the present invention comprises a winding portion formed in a ring shape and wound around the neck by a clasp and an ornamental portion connected to the winding portion and hanging down to the chest from the front of the neck, the necktie can be very easily formed in a ring shape by using the clasp and it does not take time to wear the necktie around the neck.

Furthermore, since the ornamental portion itself is made of a chain, linear body, etc., it can be bent in any direction and does not disturb the movement of a person. Moreover, the necktie can be in any shape such as downward sword-shaped, rectangular, and other neckties, and various designs can be used. Accordingly, designs appropriate for not only men, but also women can be made. As a result, neckties used by men and women can be formed.

DESCRIPTION OF THE PREFERRED EMBODIMENTS

Figure 1:
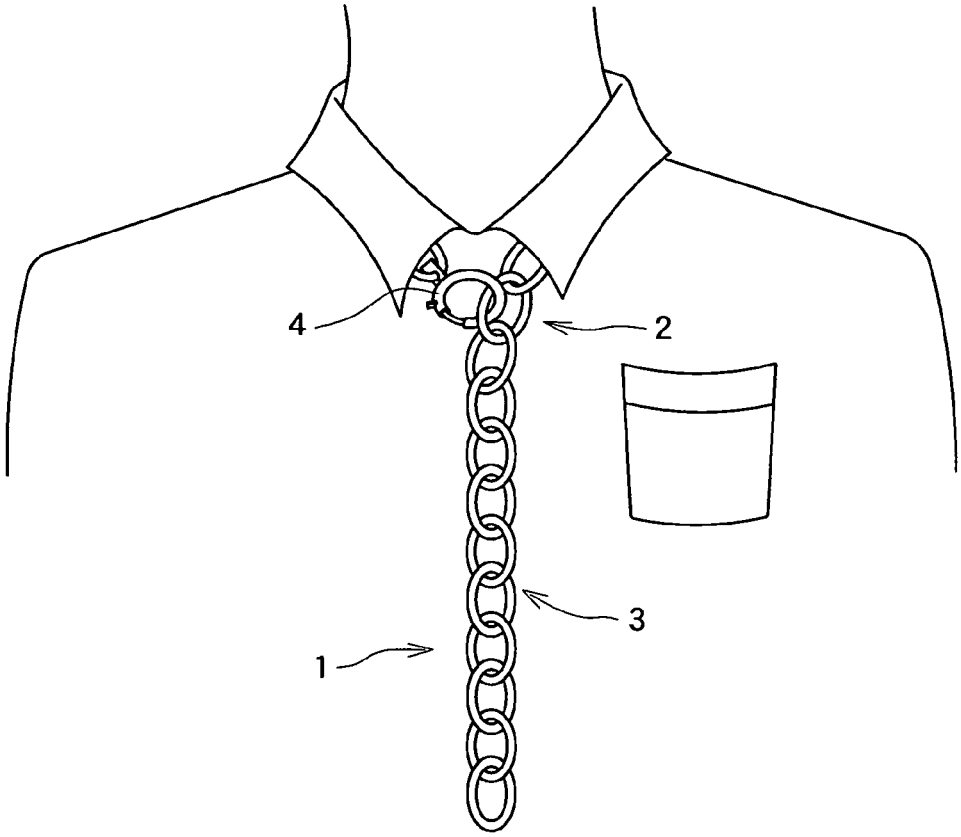
FIG. 1 is a general view in which a necktie is worn.

Hereinafter, embodiments of the present invention shown in the drawings are described.

Figure 2:
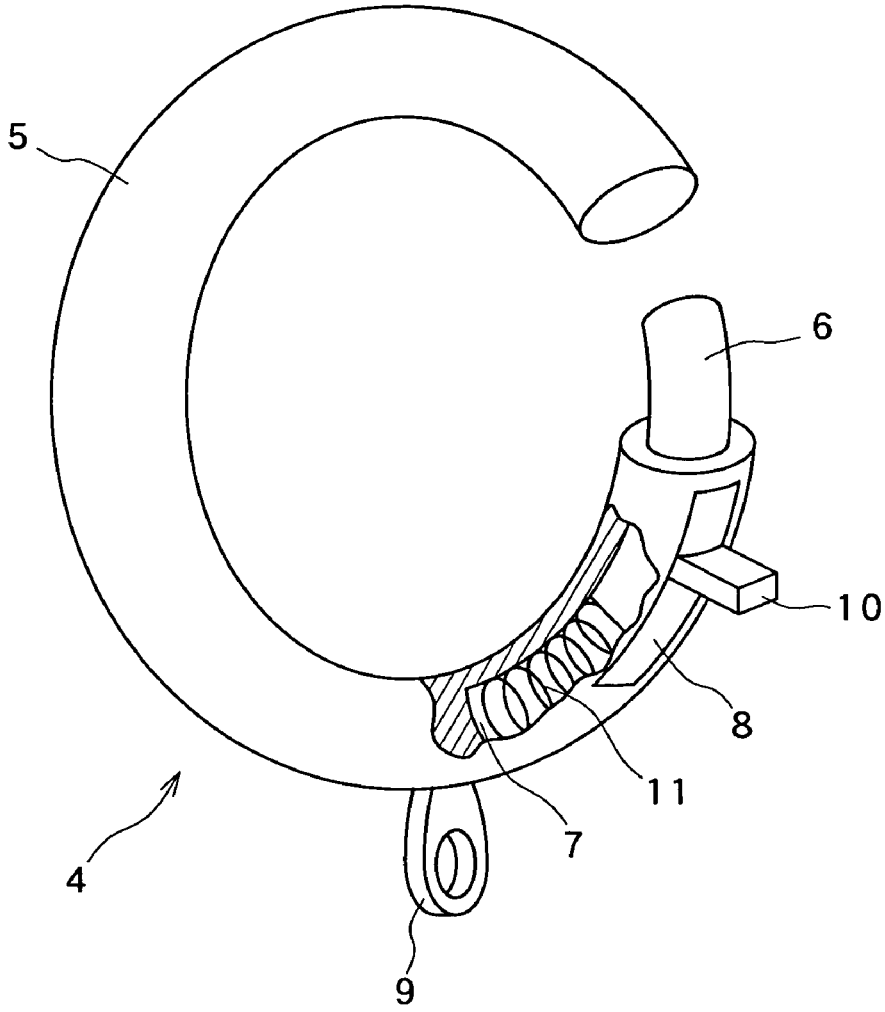
FIG. 2 is a schematic perspective view showing a clasp.
Figure 3:
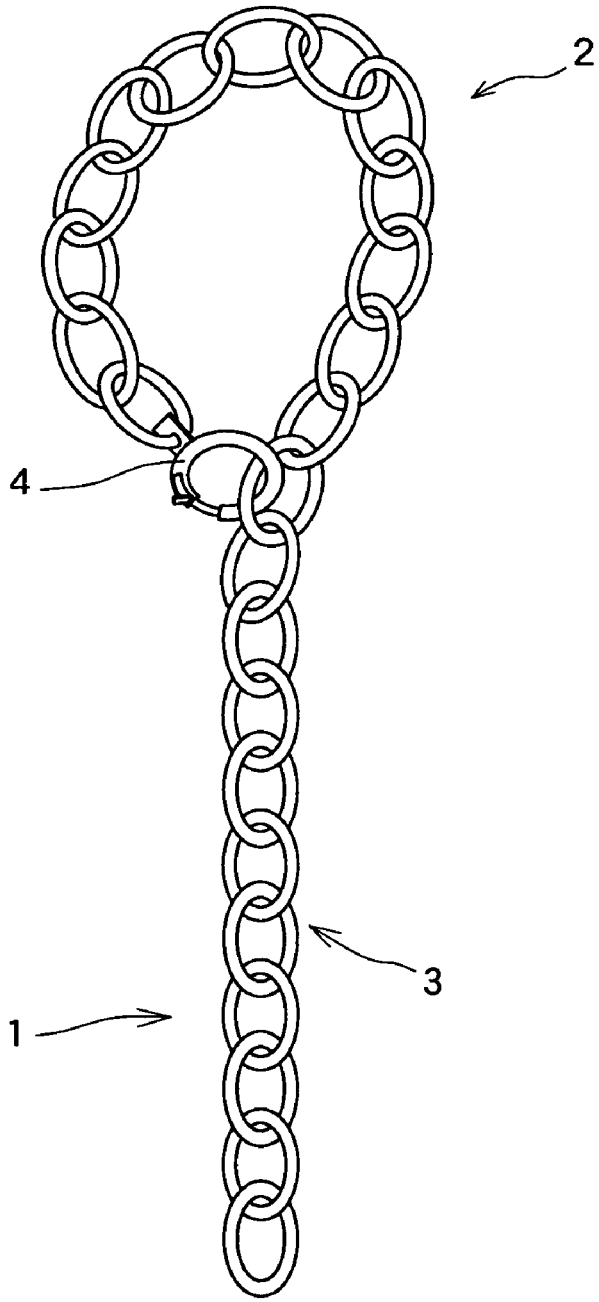
FIG. 3 shows a necktie in which the ornamental portion is made of a chain.
Figure 4:
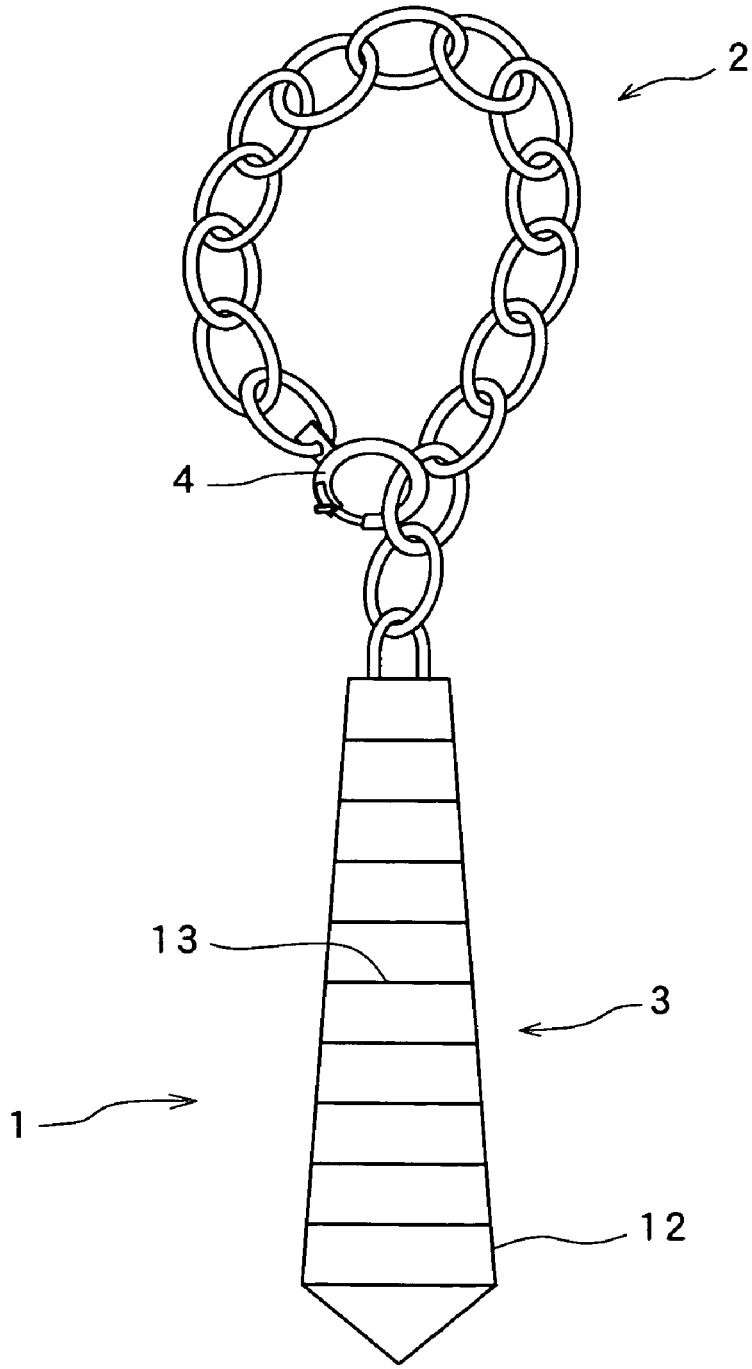
FIG. 4 shows a necktie in which the ornamental portion is downward sword-shaped.
Figure 5:
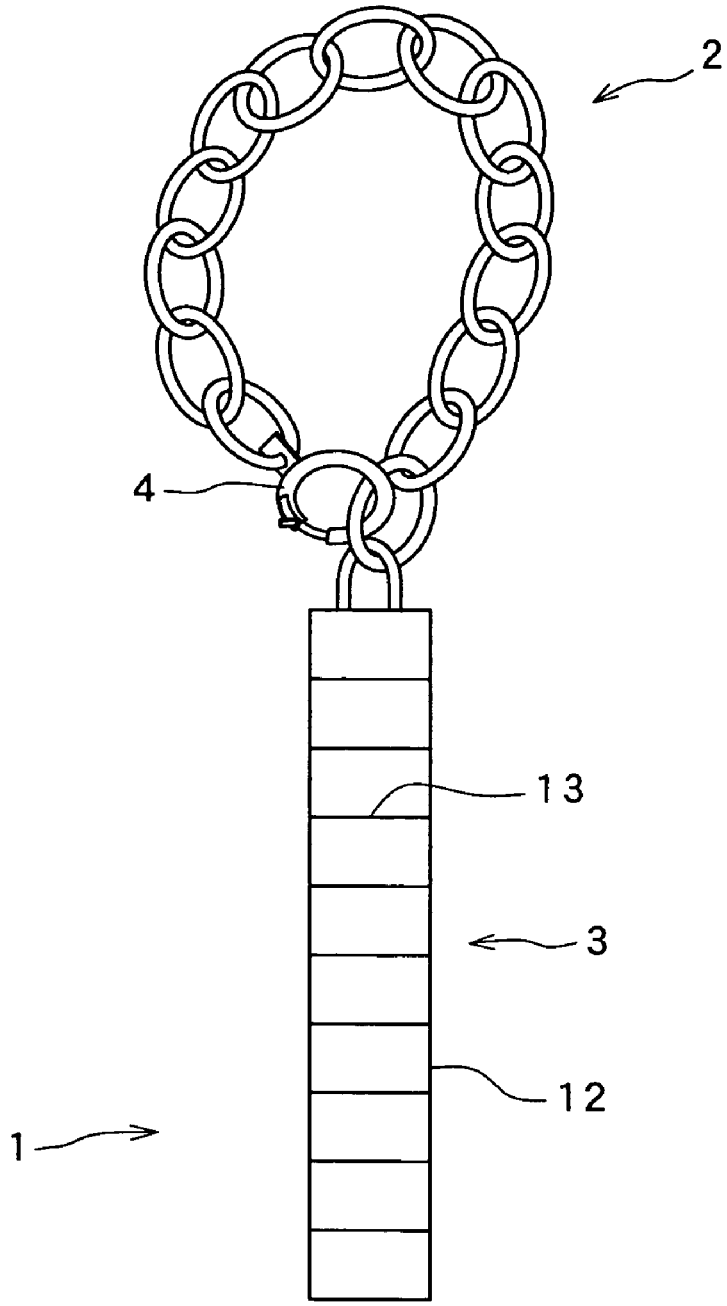
FIG. 5 shows a necktie in which the ornamental portion is formed so as to be rectangular in an upward and downward direction.

FIG. 1 is a general view showing a necktie worn with a shirt, FIG. 2 is a schematic perspective view showing a clasp, FIG. 3 shows a necktie in which the ornamental portion is made of a chain, FIG. 4 shows a necktie in which the ornamental portion is downward sword-shaped, and FIG. 5 shows a necktie in which the ornamental portion is formed so as to be rectangular in an upward and downward direction.

As shown in FIGS. 3 to 5, a necktie contains a winding portion 2 which is wound around the neck and formed to be ring-shaped when the necktie is worn and an ornamental portion 3 which is provided at one end portion of the winding portion 2 and hangs down from the front of the neck to the chest, and the winding portion 2 and the ornamental portion 3 are made of one chain.

A clasp 4 is provided at the other end of the winding portion 2 and, because of the clasp 4, the winding portion 2 is formed so as to be ring-shaped.

In a necktie 1 shown in FIG. 3, the winding portion 2 and the ornamental portion 3 are made of a chain as one body. In a necktie 1 shown in FIG. 4, an ornamental portion 3 is connected to one end of a winding portion 2 made of a chain, the ornamental portion 3 is made of a linear body which is downward sword-shaped, and the whole body can be bent in any direction. In a necktie 1 shown FIG. 5, an ornamental portion 3 is connected to one end of a winding portion 2 made of a chain, the ornamental portion is made of a linear body which is rectangular in an upward and downward direction, and the whole body can be bent in any direction.

Next, a case in which a necktie is worn is described.

As shown in FIG. 1, a necktie 1 can be worn in such a way that a winding portion 2 is passed through under a turn-back portion of a collar, the winding portion 2 is wound around the neck, and a clasp 4 is attached at any location of the winding portion 2 so as to come in front of the neck.

The clasp 4 can be attached to and removed from any location of the winding portion 2, the clasp 4 can cope with the size around the neck which is dependent on a person wearing the clasp 4, and the clasp 4 can be attached at any location chosen by the person wearing the clasp 4.

The winding portion 2 is made of a chain and it is desirable that the chain have divisions divided at certain distances so that a clasp 4 may be used at short distances. Moreover, the winding portion 2 is not made of a chain, but may be made of another chain-like material. In this case, a clasp appropriate for the chain-like material is used.

As shown in FIG. 2, the clasp 4 is composed of a substantially C-shaped clasp main body 5 in which a part of a ring-shaped body is cut off and an opening and closing axis 6 for opening and closing the cut portion of the clasp main body.

The clasp main body 5 is a cylinder made of a metal, etc., which is formed so as to be substantially C-shaped and a hole in which the opening and closing axis can be put in is provided on one end surface of the clasp main body 5.

Furthermore, a groove 8 is provided on the outer surface of one end portion of the clasp main body 5, and, on the outer surface portion of the clasp main body 5, a connection portion 9 which is fixed to the other end of the winding portion 2 is provided so as to protrude.

The opening and closing axis 6 is provided so as to close the cut portion between both end portions of the clasp main body 5.

Furthermore, a protrusion 10 protruded from the groove 8 is provided on the opening and closing axis 6, the protrusion 10 is slidable along the groove 8, and the end portion of the opening and closing axis 6 is provided inside the hole 7 of the clasp main body 5.

Then, a spring 11 is provided between the end of the hole 7 and the end portion of the opening and closing axis 6 inside the hole 7 of the clasp main body 5, the opening and closing axis 6 is pressed so as to be continuously protruded, and the cut portion is closed in such a way that the protrusion end of the opening and closing axis 6, which is protruded, is in contact with the clasp main body 5.

Furthermore, when the cut portion of the clasp main body 5 is made open, the protrusion 10 is slid by a finger so as to resist the spring 11. Thus, the opening and closing axis 6 proceeds to the inside of the hole 7 and the cut portion of the clasp main portion 5 is made open. Furthermore, when the finger is removed from the protrusion 10 which has been slid, the opening and closing axis 6 is pushed out by the force of the spring 11 provided inside the hole 7 and then the cut portion is closed.

Moreover, the clasp 4 is not limited to the above construction, and clasps of various constructions can be used. What is essential is that the clasp 4 is attachable to and removable from any point of the winding portion 2.

FIG. 3 shows the form of a necktie 1 in which the winding portion 2 and the ornamental portion 3 are made of one chain, and, in this embodiment, the whole body is made of a chain-like bow tie.

FIG. 4 shows the form of a necktie 1 in which the ornamental portion 3 is made of a linear body so as to be downward sword-shaped and can be bent in any direction. Then, in the ornamental portion, a plurality of bridge portions 13 is provided so as to form an outer frame portion 12 being downward and sword-shaped and connect the inner portions of the rectangular outer frame portion 12.

FIG. 5 shows the form of a necktie 1 in which the ornamental portion 3 is made of a linear body so as to be rectangular in the upward and downward direction and can be bent in any direction. Then, in the ornamental portion 3, an outer frame portion 12 is formed so as to be rectangular and a plurality of bridge portions 13 are provided to connect the inner portions of the rectangular outer frame portion 12.

Moreover, when the downward sword-shaped and rectangular ornamental portions are constructed, a plurality of linear bodies are connected by connecting means such as welding, etc., or they are formed by stamping a flexible plate material, etc.

Since the ornamental portion 3 is formed by a chain itself or a combination of linear bodies, the whole body bends in accordance with the movement of the body of a person wearing the necktie and the necktie 1 does not disturb the movement of the body.

Moreover, the ornamental portions 3 are not limited to the embodiments of the present invention, and, although the size and material are not restricted, it is desirable that the ornamental portion 3 be light so as not to impose a burden on the neck in wearing a necktie 1.

When a necktie 1 is constructed as described above, since a clasp 4 can be easily attached at any location of a winding portion 2, it becomes easy to wear the necktie 1.

Furthermore, since an ornamental portion 3 is provided at one end of a winding portion 2, the freedom of designing a necktie is expanded and it becomes appropriate for women to wear the necktie.

What is claimed is:

1. A necktie comprising:

a) winding portion for encircling the neck of a wearer, the winding portion formed from a length of chain having a plurality of spaced divisions and including a clasp that is selectively and releasably engagable with any of the divisions for adjusting the size of the winding portion to the neck size of the wearer; and b) an ornamental portion extending from the winding portion for hanging down from the front of the neck when the necktie is worn by the wearer.

2. The necktie of claim 1, wherein the winding portion and the ornamental portion are integrally formed from a length of chain having a plurality of spaced divisions.

3. The necktie of claim 1, wherein the ornamental portion is a bendable sword-shaped body.

4. The necktie of claim 1, wherein the ornamental portion is a bendable rectangular-shaped body.

* * * * *